US011335182B2

(12) United States Patent
Orellana et al.

(10) Patent No.: US 11,335,182 B2
(45) **Date of Patent: *May 17, 2022**

(54) METHODS AND SYSTEMS FOR DETECTING INTRUSIONS IN A MONITORED VOLUME

(71) Applicant: Outsight, Paris (FR)

(72) Inventors: Raul Bravo Orellana, Paris (FR); Olivier Garcia, Paris (FR)

(73) Assignee: Outsight, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/136,529

(22) Filed: Dec. 29, 2020

(65) Prior Publication Data

US 2021/0125487 A1 Apr. 29, 2021

Related U.S. Application Data

(63) Continuation of application No. 16/303,440, filed as application No. PCT/EP2017/065359 on Jun. 22, 2017, now Pat. No. 10,878,689.

(30) Foreign Application Priority Data

Jun. 22, 2016 (EP) ..... 16175808

(51) Int. Cl.

| | |
|---|---|
| ***G08B 29/04*** | (2006.01) |
| ***G08B 13/16*** | (2006.01) |
| ***G08B 13/196*** | (2006.01) |

(52) U.S. Cl.

CPC ..... *G08B 29/04* (2013.01); *G08B 13/1672* (2013.01); *G08B 13/19608* (2013.01); *G08B 13/19682* (2013.01); *G08B 13/19691* (2013.01)

(58) Field of Classification Search

CPC ..... G08B 29/04; G08B 13/1672; G08B 13/19608; G08B 13/19682; G08B 13/19691

See application file for complete search history.

(56) References Cited

U.S. PATENT DOCUMENTS

| | | | |
|---|---|---|---|
| 5,517,429 | A | 5/1996 | Harrison |
| 6,188,319 | B1 | 2/2001 | Frucht |

(Continued)

FOREIGN PATENT DOCUMENTS

| | | | |
|---|---|---|---|
| EP | 0645644 | A1 | 3/1995 |
| WO | 2017176882 | A1 | 10/2017 |

OTHER PUBLICATIONS

Besl et al., "A Method for Registration of 3-D shapes", IEEE Transactions on Pattern and Machine Intelligence, vol. 14, No. 2, Feb. 1992.

(Continued)

*Primary Examiner* — Chico A Foxx
(74) *Attorney, Agent, or Firm* — Daylight Law, P.C.

(57) ABSTRACT

A method for detecting intrusions in a monitored volume in which: N tridimensional sensors acquire local point clouds in respective local coordinate systems, a central processing unit receives the acquired local point clouds and, for each sensor, computes updated tridimensional position and orientation of the sensor in a global coordinate system of the monitored volume by aligning a local point cloud acquired by said tridimensional sensor with a global tridimensional map of the monitored volume, and generates an aligned local point cloud on the basis of the updated tridimensional position and orientation of the sensor, the central processing unit monitors an intrusion in the monitored volume by comparing a free space of the aligned local point cloud with a free space of the global tridimensional map.

15 Claims, 3 Drawing Sheets

(56) References Cited

U.S. PATENT DOCUMENTS 6,560,354 B1 * 5/2003 Maurer, Jr ..... G06T 7/33 128/922
7,084,761 B2 8/2006 Izumi et al.
7,164,116 B2 1/2007 Akagi
7,317,456 B1 1/2008 Lee
7,433,493 B1 10/2008 Miyoshi et al.
7,652,238 B2 1/2010 Haberer et al.
7,940,955 B2 5/2011 Zhang et al.
7,995,096 B1 8/2011 Cressy et al.
8,648,923 B2 2/2014 Iwasaki
8,890,936 B2 11/2014 Sharma et al.
9,087,258 B2 7/2015 Yu et al.
9,151,446 B2 10/2015 Doettling et al.
9,412,040 B2 8/2016 Feng et al.
9,536,348 B2 1/2017 Cornett et al.
9,575,180 B2 2/2017 Miller et al.
9,639,760 B2 * 5/2017 Ottlik ..... G06K 9/46
9,784,566 B2 10/2017 Laffargue
9,823,059 B2 11/2017 Li et al.
9,841,311 B2 12/2017 McCloskey et al.
9,857,167 B2 1/2018 Jovanovski et al.
10,142,538 B2 11/2018 Hurd
10,203,402 B2 2/2019 Jovanovski et al.
10,249,030 B2 4/2019 McCloskey et al.
10,436,904 B2 * 10/2019 Moss ..... G01S 7/4817
2003/0235331 A1 12/2003 Kawaike et al.
2004/0169131 A1 9/2004 Hardin et al.
2004/0263625 A1 12/2004 Ishigami et al.
2005/0036036 A1 2/2005 Stevenson et al.
2006/0049930 A1 3/2006 Zruya et al.
2007/0035627 A1 2/2007 Cleary et al.
2007/0039030 A1 2/2007 Romanowich et al.
2009/0033746 A1 2/2009 Brown et al.
2009/0129556 A1 * 5/2009 Ahn ..... A61B 6/04 378/208
2009/0153326 A1 6/2009 Doumi et al.
2009/0288011 A1 11/2009 Piran et al.
2010/0053330 A1 3/2010 Hellickson et al.
2010/0117889 A1 * 5/2010 Grube ..... G01S 13/87 342/107
2010/0271615 A1 10/2010 Sebastian et al.
2010/0321492 A1 12/2010 Cornett et al.
2012/0086780 A1 4/2012 Sharma et al.
2012/0123563 A1 * 5/2012 Drinkard ..... F16P 3/142 700/13
2012/0286136 A1 11/2012 Krill et al.
2012/0293625 A1 * 11/2012 Schneider ..... G01B 11/25 348/46
2013/0141543 A1 6/2013 Choi et al.
2013/0208098 A1 8/2013 Alcolado et al.
2014/0191938 A1 * 7/2014 Ybanez Zepeda ..... G06F 3/017 345/156
2014/0225988 A1 * 8/2014 Poropat ..... G01B 11/14 348/46
2015/0062123 A1 * 3/2015 Yuen ..... G06T 19/20 345/420
2015/0193936 A1 * 7/2015 Warzelhan ..... G08B 13/19615 382/103
2015/0242691 A1 * 8/2015 Ottlik ..... G08B 13/19652 382/103
2015/0249807 A1 9/2015 Naylor et al.
2015/0288951 A1 10/2015 Mallet et al.
2015/0323672 A1 * 11/2015 Shen ..... G01S 7/4808 382/154
2016/0073081 A1 3/2016 Becker et al.
2016/0370220 A1 12/2016 Ackley et al.
2017/0282369 A1 10/2017 Hull
2017/0323443 A1 * 11/2017 Dhruwdas ..... G06T 7/0012
2017/0328987 A1 * 11/2017 Singer ..... G01S 17/42
2018/0010911 A1 * 1/2018 Fang ..... G01S 5/20
2018/0268256 A1 * 9/2018 Di Febbo ..... G06K 9/6273
2020/0097755 A1 3/2020 Li et al.

OTHER PUBLICATIONS

Chen et al., "Object Modeling by Registration of Multiple Range Images", Proceedings of the 1991 IEEE International Conference on Robotics and Automation, Sacramento, California, Apr. 1991.
International Search Report dated Sep. 5, 2017 from International Patent Application No. PCT/EP2017/065359.
Larry Li, "Time-of-Flight Camera—An Introduction", May 31, 2014, XP055300210, retrieved from the Internet: URL: http://www.ti.com/lit/wp/sloa190b/sloa190b.pdf [retrieved on Sep. 6, 2016], figures 4/5, p. 3, right-hand col., paragraph 3.
Nonfinal Office Action dated Apr. 24, 2020 from U.S. Appl. No. 16/303,440, 12 pages.
Notice of Allowance dated Aug. 18, 2020 from U.S. Appl. No. 16/303,440), 32 pages.

* cited by examiner

METHODS AND SYSTEMS FOR DETECTING INTRUSIONS IN A MONITORED VOLUME

CROSS-REFERENCE TO RELATED APPLICATIONS

This application is a continuation of U.S. patent application Ser. No. 16/303,440, filed on Nov. 20, 2018, which was the National Stage of International Application No. PCT/EP2017/065359, filed Jun. 22, 2017, which claims priority to European Patent Organization Patent Application No. EP16175808, filed on Jun. 22, 2016, all of which are incorporated by reference herein in their entirety for all purposes.

FIELD OF THE INVENTION

The instant invention relates to methods and system for detecting intrusions in a 3-dimensional volume or space.

BACKGROUND OF THE INVENTION

The present application belongs to the field of area and volume monitoring for surveillance applications such as safety engineering or site security. In such applications, regular or continuous checks are performed to detect whether an object, in particular a human body, intrudes into a monitored volume, for instance a danger zone surrounding a machine or a forbidden zone in a private area. When an intrusion has been detected, an operator of the monitoring system is notified and/or the installation may be stopped or rendered harmless.

Traditional approaches for area monitoring involve using a 2D camera to track individuals and objects in the spatial area. US 20060033746 describes an example of such a camera monitoring.

Using a bidimensional camera provides a low-cost and easy-to-setup monitoring solution. However, an important drawback of these approaches lays in the fact that a single camera only gives bidimensional position information and provides no information on the distance of the detected object from the camera. As a result, false alerts may be triggered for distant objects that appear to be lying in the monitored volume but are actually outside of the danger or forbidden zone.

To overcome this problem, it was proposed to use distance or three-dimensional sensors or stereo-cameras to acquire tridimensional information on the individuals and objects located in the monitored spatial area. Such a monitoring system usually comprises several 3D sensors or stereo-cameras spread across the monitored area in order to avoid shadowing effect from objects located inside the monitored volume.

U.S. Pat. Nos. 7,164,116, 7,652,238 and 9,151,446 describe examples of such 3D sensors systems.

In U.S. Pat. No. 7,164,116, each sensor is considered independently, calibrated separately and have its acquisition information treated separately from the other sensors. The operator of the system can then combine the information from several 3D sensors to solve shadowing issues. Calibration and setup of such a system is a time expensive process since each 3D sensor has to be calibrated independently, for instance by specifying a dangerous or forbidden area separately for each sensor. Moreover, the use of such a system is cumbersome since the information from several sensors has to be mentally combined by the operator.

U.S. Pat. Nos. 7,652,238 and 9,151,446 disclose another approach in which a uniform coordinate system is defined for all 3D sensors of the monitoring system. The sensors are thus calibrated in a common coordinates system of the monitored volume. However, in such systems, the respective position of each sensor with respect to the monitored zone has to be fixed and stable over time to be able to merge the measurements in a reliable manner, which is often difficult to guarantee over time and result in the need to periodically recalibrate the monitoring system.

Moreover, the calibration process of these systems requires an accurate determination of each sensor three-dimensional position and orientation which involves 3D measurement tools and 3D input interface that are difficult to manage for a layman operator.

The present invention aims at improving this situation.

To this aim, a first object of the invention is a method for detecting intrusions in a monitored volume, in which a plurality of N tridimensional sensors respectively monitor at least a part of the monitored volume and respectively communicate with a central processing unit, comprising:

each sensor of said plurality of N tridimensional sensors acquiring a local point cloud in a local coordinate system of said sensor, said local point cloud comprising a set of tridimensional data points of object surfaces in a local volume surrounding said sensor and overlapping the monitored volume, said central processing unit receiving the acquired local point clouds from the plurality of N tridimensional sensors, storing said acquired point clouds in a memory and, for each sensor of said plurality of N tridimensional sensors, computing updated tridimensional position and orientation of said sensor in a global coordinate system of the monitored volume by aligning a local point cloud acquired by said tridimensional sensor with a global tridimensional map of the monitored volume stored in a memory, and generating an aligned local point cloud from said acquired point cloud on the basis of the updated tridimensional position and orientation of the sensor, monitoring an intrusion in the monitored volume by comparing a free space of said aligned local point cloud with a free space of the global tridimensional map.

In some embodiments, one might also use one or more of the following features:

for each sensor of said at least two tridimensional sensors, the updated tridimensional position and orientation of said sensor in the global coordinate system is computed by performing a simultaneous multi-scans alignment of each point clouds acquired by said sensor with the global tridimensional map of the monitored volume;

the updated tridimensional position and orientation of each sensor of said at least two sensors is computed only from the local point clouds acquired by said tridimensional sensor and the global tridimensional map of the monitored volume stored in a memory, and without additional positioning information;

the N tridimensional sensors are located so that the union of the local volumes surrounding said sensors is a connected space, said connected space forming the monitored volume, the global tridimensional map of the monitored volume is determined by receiving at least one local point cloud from each of said at least two tridimensional sensors and storing said local point clouds in a memory, performing a simultaneous multi-scans alignment of the stored local point clouds to generate a plurality of aligned local point clouds respectively associated to the local point clouds acquired from each of said at least two tridimensional sensors, and merging said plurality of aligned local point clouds to determine a global tridimensional map of the monitored volume and storing said global tridimensional map in the memory;

the method further comprises displaying to a user a graphical indication of the intrusion on a display device;

the method further comprises generating a bidimensional image of the monitored volume by projecting the global tridimensional map of the monitored volume, and commanding the display device to display the graphical indication of the intrusion overlaid over said bidimensional image of the monitored volume;

the method further comprises commanding the display device to display the graphical indication of the intrusion overlaid over a bidimensional image of at least a part of the monitored volume acquired by a camera of the self-calibrated monitoring system;

the method further comprises orienting the camera of the self-calibrated monitoring system so that the detected intrusion is located in a field of view of the camera.

Another object of the invention is a method for extending a volume monitored by a method as detailed above, in which a plurality of N tridimensional sensors respectively monitor at least a part of the monitored volume and respectively communicate with a central processing unit, comprising:

positioning an additional N+lth tridimensional sensor communicating with the central processing unit, the additional N+lth tridimensional sensor acquiring a local point cloud in a local coordinate system of said sensor, said local point cloud comprising a set of tridimensional data points of object surfaces in a local volume surrounding said sensor and at least partially overlapping the volume monitored by the plurality of N tridimensional sensors, determining an updated global tridimensional map of the self-calibrated monitoring system by receiving at least one local point cloud acquired from each of said at least two tridimensional sensors and storing said local point clouds in a memory, performing a simultaneous multi-scans alignment of the stored local point clouds to generate a plurality of aligned local point clouds respectively associated to the local point clouds acquired from each of said at least two tridimensional sensors, and determining a global tridimensional map of a monitored volume by merging said plurality of aligned local point clouds.

Another object of the invention is a method for determining a tridimensional location of a camera for a self-calibrated monitoring system, in which a plurality of N tridimensional sensors respectively monitor at least a part of the monitored volume and respectively communicate with a central processing unit, providing a camera comprising at least one reflective pattern such that a data point of said reflective pattern acquired by a tridimensional sensor of the self-calibrated monitoring system can be associated to said camera, positioning the camera in the monitored volume, in a field of view of at least one sensor of the plurality of N tridimensional sensors so that said sensor acquire a local point cloud comprising at least one tridimensional data point of the reflective pattern of the camera, receiving a local point cloud from said at least one tridimensional sensor and computing an aligned local point cloud by aligning said local point cloud with the global tridimensional map of the self-calibrated monitoring system, identifying, in the aligned local point cloud at least one data point corresponding to the reflective pattern of the camera, and determining at least a tridimensional location of the camera in a global coordinate system of the global tridimensional map on the basis of the coordinates of said identified data point of the aligned local point cloud corresponding to the reflective pattern of the camera.

Another object of the invention is a self-calibrated monitoring system for detecting intrusions in a monitored volume, the system comprising:

a plurality of N tridimensional sensors respectively able to monitor at least a part of the monitored volume, each sensor of said plurality of N tridimensional sensors being able to acquire a local point cloud in a local coordinate system of said sensor, said local point cloud comprising a set of tridimensional data points of object surfaces in a local volume surrounding said sensor and overlapping the monitored volume, a memory to store said local point cloud and a global tridimensional map of a monitored volume comprising a set of tridimensional data points of object surfaces in a monitored volume, the local volume at least partially overlapping the monitored volume, a central processing unit able to receive the acquired local point clouds from the plurality of N tridimensional sensors, store said acquired point clouds in a memory and, for each sensor of said plurality of N tridimensional sensors, compute updated tridimensional position and orientation of said sensor in a global coordinate system of the monitored volume by aligning a local point cloud acquired by said tridimensional sensor with a global tridimensional map of the monitored volume stored in a memory, generate an aligned local point cloud from said acquired point cloud on the basis of the updated tridimensional position and orientation of the sensor, and monitor an intrusion in the monitored volume by comparing a free space of said aligned local point cloud with a free space of the global tridimensional map.

In some embodiments, one might also use one or more of the following features:

the system further comprises at least one camera able to acquire a bidimensional image of a portion of the monitored volume;

said at least one camera comprises at least one reflective pattern such that a data point of said reflective pattern acquired by a tridimensional sensor of the self-calibrated monitoring system can be associated to said camera by the central processing unit of the system;

the system further comprises at least one display device able to display to a user a graphical indication of the intrusion.

Another object of the invention is a non-transitory computer readable storage medium, having stored thereon a computer program comprising program instructions, the computer program being loadable into a central processing unit of a monitoring system as detailed above and adapted to cause the processing unit to carry out the steps of a method as detailed above, when the computer program is run by the central processing unit.

BRIEF DESCRIPTION OF THE DRAWINGS

Other characteristics and advantages of the invention will readily appear from the following description of several of its embodiments, provided as non-limitative examples, and of the accompanying drawings.

On the drawings.

On the different figures, the same reference signs designate like or similar elements.

DETAILED DESCRIPTION

Figure 1:
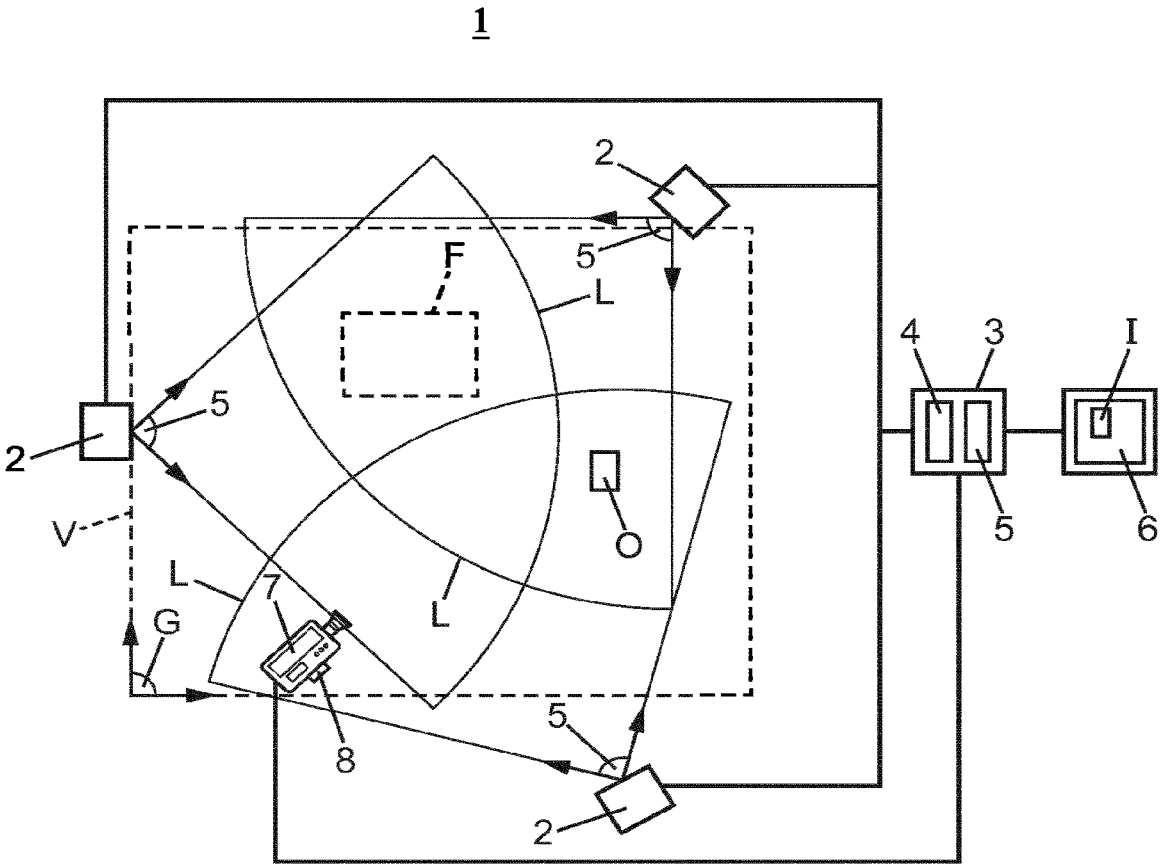
FIG. 1 is a schematic top view of a monitoring system for detecting intrusions in a monitored volume according to an embodiment of the invention.

FIG. 1 illustrates a self-calibrated monitoring system 1 for detecting intrusions in a monitored volume V, able to perform a method for detecting intrusions in a monitored volume as detailed further below.

The monitoring system 1 can be used for monitoring valuable objects (strongroom monitoring et al.) and/or for monitoring entry areas in public buildings, at airports etc. The monitoring system 1 may also be used for monitoring hazardous working areas around a robot or a factory installation for instance. The invention is not restricted to these applications and can be used in other fields.

The monitored volume V may for instance be delimited by a floor F extending along a horizontal plane H and real or virtual walls extending along a vertical direction Z perpendicular to said horizontal plane H.

The monitored volume V may comprise one or several danger zones or forbidden zones F. A forbidden zone F may for instance be defined by the movement of a robot arm inside volume V. Objects intruding into the forbidden zone F can be put at risk by the movements of the robot arm so that an intrusion of this kind must, for example, result in a switching off of the robot. A forbidden zone F may also be defined as a private zone that should only be accessed by accredited persons for security reasons.

A forbidden zone F is thus a spatial area within the monitoring zone that may encompass the full monitoring zone in some embodiments of the invention.

As illustrated on FIG. 1, the monitoring system 1 comprises a plurality of N tridimensional sensors 2 and a central processing unit 3.

In one embodiment, the central processing unit 3 is separated from the sensors 2 and is functionally connected to each sensor 2 in order to be able to receive data from each sensor 2. The central processing unit 3 may be connected to each sensor 2 by a wired or wireless connection.

In a variant, the central processing unit 3 may be integrated in one of the sensors 2, for instance by being a processing circuit integrated in said sensor 2.

The central processing unit 3 collects and processes the point clouds from all the sensors 2 and is thus advantageously a single centralized unit.

The central processing unit 3 comprises for instance a processor 4 and a memory 5.

The number N of tridimensional sensors 2 of the monitoring system 1 may be comprised between 2 and several tens of sensors.

Each tridimensional sensor 2 is able to monitor a local volume L surrounding said sensor 2 that overlaps the monitored volume V.

More precisely, each tridimensional sensor 2 is able to acquire a local point cloud C in a local coordinate system S of said sensor 2. A local point cloud C comprises a set of tridimensional data points D. Each of the data points D of the local point cloud C corresponds to a point P of a surface of an object located in the local volume L surrounding the sensor 2.

By a "tridimensional data point", it is understood three-dimensional coordinates of a point P in the environment of the sensor 2. A tridimensional data point D may further comprise additional characteristics, for instance the intensity of the signal detected by the sensor 2 at said point P.

The local coordinate system S of said sensor 2 is a coordinate system S related to said sensor 2, for instance with an origin point located at the sensor location. The local coordinate system S may be a cartesian, cylindrical or polar coordinate system.

A tridimensional sensor 2 may for instance comprise a laser rangefinder such as a light detection and ranging (LIDAR) module, a radar module, an ultrasonic ranging module, a sonar module, a ranging module using triangulation or any other device able to acquire the position of a single or a plurality of points P of the environment in a local coordinate system S of the sensor 2.

In a preferred embodiment, a tridimensional sensor 2 emits an initial physical signal and receives a reflected physical signal along controlled direction of the local coordinate system. The emitted and reflected physical signals can be for instance light beams, electromagnetic waves or acoustic waves.

The sensor 2 then computes a range, corresponding to a distance from the sensor 2 to a point P of reflection of the initial signal on a surface of an object located in the local volume L surrounding the sensor 2. Said range may be computed by comparing the initial signal and the reflected signal, for instance by comparing the time or the phases of emission and reception.

A tridimensional data point D can then be computed from said range and said controlled direction.

In one example, the sensor 2 comprises a laser emitting light pulses with a constant time rate, said light pulses being deflected by a moving mirror rotating along two directions. Reflected light pulses are collected by the sensor and the time difference between the emitted and the received pulses give the distance of reflecting surfaces of objects in the local environment of the sensor 2. A processor of the sensor 2, or a separate processing unit, then transform, using simple trigonometric formulas, each observation acquired by the sensor into a three-dimensional data point D.

A full scan of the local environment of sensor 2 is periodically acquired and comprises a set of tridimensional data points D representative of the objects in the local volume of the sensor 2.

By "full scan of the local environment", it is meant that the sensor 2 has covered a complete field of view. For instance, after a full scan of the local environment, the moving mirror of a laser-based sensor is back to an original position and ready to start a new period of rotational movement. A local point cloud C of the sensor 2 is thus also sometimes called a "frame" and is the three-dimensional equivalent of a frame acquired by a bi-dimensional camera.

A set of tridimensional data points D acquired in a full scan of the local environment of sensor 2 is called a local point cloud C.

The sensor 2 is able to periodically acquire local point clouds C with a given framerate.

The local point clouds C of each sensor 2 are transmitted to the central processing unit 3 and stored in the memory 5 of the central processing unit 3.

As detailed below, the memory 5 of the central processing unit 3 also store a global tridimensional map M of the monitored volume V.

The global tridimensional map M comprises a set of tridimensional data points D of object surfaces in the monitored volume V.

Figure 2:
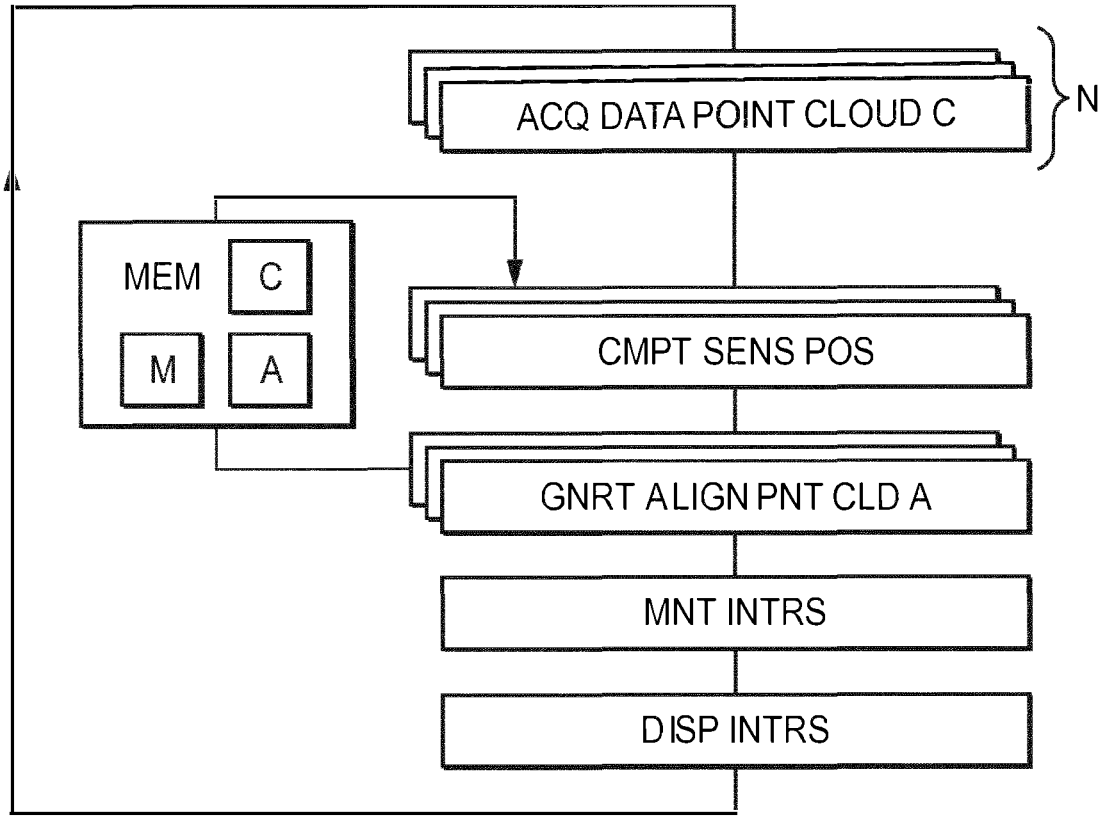
FIG. 2 is a flowchart detailing a method for detecting intrusions in a monitored volume according to an embodiment of the invention.

A method for detecting intrusions in a monitored volume will now be disclosed in greater details with reference to FIG. 2.

The method for detecting intrusions is performed by a monitoring system 1 as detailed above.

In a first step of the method, each sensor 2 of the N tridimensional sensors acquires a local point cloud C in a local coordinate system S of said sensor 2 as detailed above.

The central processing unit 3 then receives the acquired local point clouds C from the N sensors 2 and stores said acquired point clouds C in the memory 5.

The memory 5 may contain other local point clouds C from previous acquisitions of each sensor 2.

In a second step, the central processing unit 3 perform several operations for each sensor 2 of the N tridimensional sensors.

The central processing unit 3 first computes updated tridimensional position and orientation of each sensor 2 in a global coordinate system G of the monitored volume V by aligning at least one local point cloud C acquired by said sensor 2 with the global tridimensional map M of the monitored volume V stored in the memory 5.

By "tridimensional position and orientation", it is understood 6D localisation information for a sensor 2, for instance comprising 3D position and 3D orientation of said sensor 2 in a global coordinate system G.

The global coordinate system G is a virtual coordinate system obtained by aligning the local point clouds C. The global coordinate system G may not need to be calibrated with regards to the real physical environment of the system 1, in particular if no forbidden zone F has to be defined.

Thanks to these features of the method and system according to the invention, it is possible to automatically recalibrate the position of each sensor 2 at each frame. Calibration errors are thus greatly reduced and the ease of use of the system is increased. This solves the problem of reliability when sensors move in the wind or move due to mechanical shocks.

The updated tridimensional position and orientation of a sensor 2 are computed only from the local point clouds C acquired by said sensor 2 and from the global tridimensional map M of the monitored volume stored in a memory, and without additional positioning information.

By "without additional positioning information", it is in particular meant that the computation of the updated tridimensional position and orientation of a sensor does not require other input data than the local point clouds C acquired by said sensor 2 and the global tridimensional map M. For instance, no additional localisation or orientation device, such as a GPS or an accelerometer, is required. Moreover, no assumption has to be made on the location or movement of the sensor.

To this aim, the central processing unit 3 performs a simultaneous multi-scans alignment of each point cloud C acquired by said sensor with the global tridimensional map of the monitored volume.

By "simultaneous multi-scans alignment", it is meant that the point clouds C acquired by the N sensors, together with the global tridimensional map M of the monitored volume are considered as scans that need to be aligned together simultaneously.

In one embodiment, the point clouds C acquired by the N sensors over the operating time are aligned at each step. For instance, the system may have performed M successive acquisition frames of the sensors 2 up to a current time t. The M point clouds C acquired by the N sensors are thus grouped with the global tridimensional map M to form M*N+1 scans to be aligned together by the central processing unit 3.

In a variant, the M−1 previously acquired point clouds C may be replaced by their respectively associated aligned point clouds A as detailed further below. The (M−1)*N aligned point cloud A may thus be grouped with the N latest acquired point clouds C and with the global tridimensional map M to form again M*N+1 scans to be aligned together by the central processing unit 3.

Such a simultaneous multi-scans alignment may be performed for instance by using an Iterative Closest Point algorithm (ICP) as detailed by P. J. Besl and N. D. McKay in "A method for registration of 3-d shapes" published in IEEE Transactions on Pattern Analysis and Machine Intelligence, 14(2):239-256, 1992 or in "Object modelling by registration of multiple range images" by Yang Chen and Gerard Medioni published in Image Vision Comput., 10(3), 1992. An ICP algorithm involves search in transformation space trying to find the set of pair-wise transformations of scans by optimizing a function defined on transformation space. The variant of ICP involves optimization functions that range from being error metrics like "sum of least square distances" to quality metrics like "image distance" or probabilistic metrics. In this embodiment, the central processing unit 3 may thus optimize a function defined on a transformation space of each point cloud C to determine the updated tridimensional position and orientation of a sensor 2.

This way, it is possible to easily and efficiently perform a simultaneous multi-scans alignment of each point cloud C to compute updated tridimensional position and orientation of a sensor 2.

Then, the central processing unit 3 generates an aligned local point cloud A associated to each acquired point cloud C in which the data points D of said point cloud C are translated from the local coordinate system S to the global coordinate system G of the global tridimensional map M. The aligned local point cloud A is determined on the basis of the updated tridimensional position and orientation of the sensor 2.

The aligned local point cloud A of each sensor 2 can then be reliably compared together since each sensor's position and orientation has been updated during the process.

In a subsequent step of the method, the central processing unit 3 may monitor an intrusion in the monitored volume V.

To this aim, the central processing unit 3 may compare a free space of each aligned local point cloud A with a free space of the global tridimensional map M.

To this aim, the monitoring volume V may for instance be divided in a matrix of elementary volumes E and each elementary volume E may be flagged as "free-space" or "occupied space" on the basis of the global tridimensional map M.

The aligned local point cloud A can then be used to determine an updated flag for the elementary volume E contained in the local volume L surrounding a sensor 2.

A change in flagging of an elementary volume E from "free-space" to "occupied space", for instance by intrusion of an object 0 as illustrated on FIG. 1, can then trigger the detection of an intrusion in the monitored volume V by the central processing unit 3.

Figure 3:
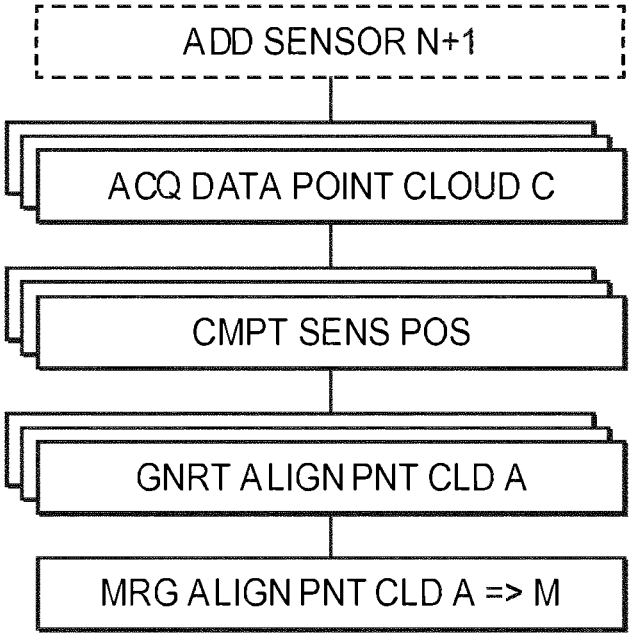
FIG. 3 is a flowchart detailing a method for determining a global tridimensional map of a monitored volume and a method for extending a monitored volume according to embodiments of the invention.

In one embodiment of the invention, the global tridimensional map M of the monitored volume V can be determined by the monitoring system 1 itself in an automated manner as it will now be described with reference to FIG. 3.

To this aim, the N tridimensional sensors may be located so that the union of the local volumes L surrounding said sensors 2 is a connected space. This connected space forms the monitored volume.

By "connected space", it is meant that the union of the local volumes L surrounding the N sensors 2 form a single space and not two or more disjoint nonempty open subspaces.

Then, a global tridimensional map M of the monitored volume V can be determined by first receiving at least one local point cloud C from each of said sensors and storing said local point clouds C in the memory 5 of the system.

The central processing unit 5 then performs a simultaneous multi-scans alignment of the stored local point clouds C to generate a plurality of aligned local point clouds A as detailed above. Each aligned local point cloud A is respectively associated to a local point cloud C acquired from a tridimensional sensor 2.

Unlike what has been detailed above, the frames used for the simultaneous multi-scans alignment do not comprise the global tridimensional map M since it has yet to be determined. The frames used for the simultaneous multi-scans alignment may comprise a plurality of M successively acquired point clouds C for each sensor 2. The M point clouds C acquired by the N sensors are thus grouped to form M*N+1 scans to be aligned together by the central processing unit 3 as detailed above.

By aligning the stored local point clouds C, a global coordinate system G is obtained in which the aligned local point clouds A can be compared together.

Once the plurality of aligned local point clouds A has been determined, the central processing unit 5 can thus merge the plurality of aligned local point clouds A to form a global tridimensional map M of the monitored volume V. The global tridimensional map M is then stored in the memory 5 of the system 1.

In one embodiment of the invention, once an intrusion has been detected by the system 1, the method may further involve displaying to a user a graphical indication I of the intrusion on a display device 6.

The display device 6 may be any screen, LCD, OLED, and the like, that is convenient for an operator of the system 1. The display device 6 is connected to, and controlled by, the central processing unit 3 of the system 1.

In a first embodiment of the method, a bidimensional image B of the monitored volume V may be generated by the processing unit 3 by projecting the global tridimensional map M of the monitored volume V along a direction of observation.

The processing unit 3 may then command the display device 6 to display the graphical indication I of the intrusion overlaid over said bidimensional image B of the monitored volume V.

In another embodiment, the system 1 may further comprise at least one camera 7. The camera 7 may be able to directly acquire a bidimensional image B of a part of the monitored volume V. The camera 7 is connected to, and controlled by, the central processing unit 3 of the system 1.

The central processing unit 3 may then command the display device 6 to display the graphical indication I of the intrusion overlaid over the bidimensional image B acquired by the camera 7.

In a variant, the central processing unit 3 may be able to control the pan, rotation or zoom of the camera 7 so that the detected intrusion can be located in a field of view of the camera 7.

Figure 4:
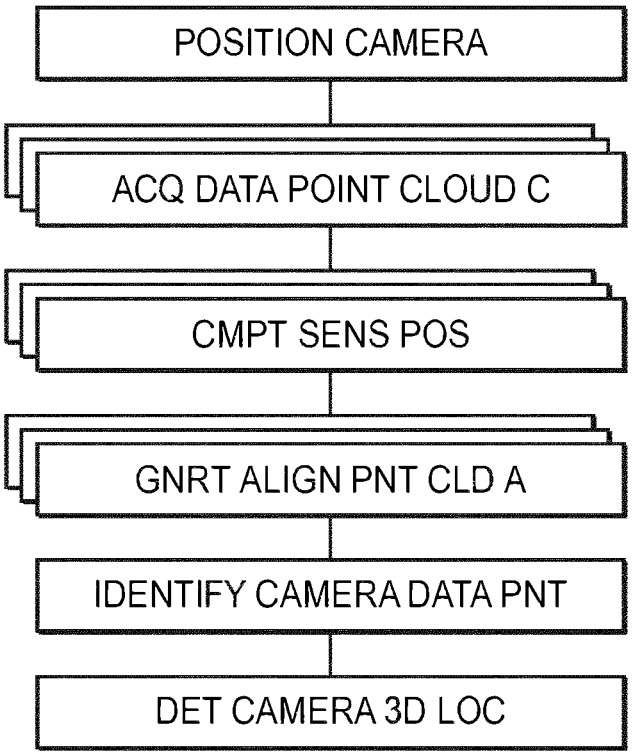
FIG. 4 is a flowchart detailing a method for determining a tridimensional location of a camera for a self-calibrated monitoring system according to an embodiment of the invention.

To this aim, another object of the invention is a method to determine a tridimensional location of a camera 7 of a self-calibrated monitoring system 1 as described above. This method allows for easy calibration without requiring a manual measurement and input of the position of the camera 7 in the monitoring volume V. An embodiment of this method is illustrated in FIG. 4.

The camera 7 is provided with at least one reflective pattern 8. The reflective pattern 8 is such that a data point of said reflective pattern acquired by a tridimensional sensor 2 of the self-calibrated monitoring system 1 can be associated to said camera by the central processing unit 3 of the system 1.

The reflective pattern 8 may be made of a high reflectivity material so that the data points of the reflective pattern 8 acquired by the sensor 2 present a high intensity, for instance an intensity over a predefined threshold intensity.

The reflective pattern 8 may also have a predefined shape, for instance the shape of a cross or a circle or "L" markers. Such a shape can be identified by the central processing unit 3 by using commonly known data and image analysis algorithms.

In a first step of the method to determine a tridimensional location of a camera 7, the camera is positioned in the monitored volume V. The camera 7 is disposed in at least one local volume L surrounding a sensor 2 of the system 1, so that the reflective pattern 8 of the camera 7 is in a field of view of at least one sensor 2 of the plurality of N tridimensional sensors. Said at least one sensor 2 is thus able to acquire a local point cloud C comprising at least one tridimensional data point D corresponding to the reflective pattern 8 of the camera 7.

The central processing unit 3 then receives a local point cloud C from said at least one tridimensional sensor and computes an aligned local point cloud A by aligning said local point cloud C with the global tridimensional map M of the self-calibrated monitoring system as detailed above.

In the aligned local point cloud A, the central processing unit 3 can then identify at least one data point corresponding to the reflective pattern 8 of the camera 7. As mentioned above, this identification may be conducted on the basis of the intensity of the data points D received from the sensor 2 and/or the shape of high intensity data points acquired by the sensor 2. This identification may be performed by using known data and image processing algorithms, for instance the OpenCV library.

Eventually, a tridimensional location and/or orientation of the camera in the global coordinate system G of the global tridimensional map M may be determined by the central processing unit 3 on the basis of the coordinates of said identified data point of the reflective pattern 8 of the camera 7 in the aligned local point cloud A.

The underlying concept of the invention can also be used for easily and efficiently extending a volume monitored by a system and a method as detailed above.

Such a method can find interest in many situations in which a slight change in the monitored volume involves moving or adding additional sensors 2 and usually requires a time-consuming and complex manual calibration of the monitoring system. On the contrary, the present invention provides for a self-calibrating system and method that overcome those problems.

Another object of the invention is thus a method for extending a volume monitored by a method and system as detailed above.

In the monitoring system 1, a plurality of N tridimensional sensors 2 respectively monitor at least a part of the monitored volume V and respectively communicate with a central processing unit 3 as detailed above. A global tridimensional map M is associated to the volume V monitored by the N tridimensional sensors 2 as detailed above.

The method for extending the volume monitored by system 1 thus involves determining an updated global tridimensional map M' of the self-calibrated monitoring system associated to an updated volume V' monitored by the N+1 tridimensional sensors 2.

The method for extending the volume monitored by system 1 involves first positioning an additional N+lth tridimensional sensor 2 able to communicate with the central processing unit 3.

The additional N+lth tridimensional sensor 2 is similar to the N sensors 2 of the monitoring system 1 and is thus able to acquire a local point cloud C in a local coordinate system L of said sensor 2. This local point cloud C comprises a set of tridimensional data points D of object surfaces in a local volume L surrounding said sensor 2. The local volume L at least partially overlaps the volume V monitored by the plurality of N tridimensional sensors.

The updated global tridimensional map M of the self-calibrated monitoring system may then be determined as follows.

First, the central processing unit 3 receives at least one local point cloud C acquired from each of said at least two tridimensional sensors and storing said local point clouds in a memory.

Then, the central processing unit 3 performs a simultaneous multi-scans alignment of the stored local point clouds C to generate a plurality of aligned local point clouds A respectively associated to the local point clouds C acquired from each sensor 2 as detailed above.

The multi-scans alignment can be computed on a group of scans comprising the global tridimensional map M.

This is in particular interesting if the union of the local volumes L surrounding the tridimensional sensors 2 is not a connected space.

The multi-scans alignment can also be computed only on the point clouds C acquired by the sensors 2.

In this case, the determination of the updated global tridimensional map M is similar to computation of the global tridimensional map M of the monitored volume V by the monitoring system 1 as detailed above.

Once the plurality of aligned local point clouds A has been determined, the central processing unit 5 can then merge the plurality of aligned local point clouds A and, if necessary, the global tridimensional map M, to form an updated global tridimensional map M' of the updated monitored volume V'.

The updated global tridimensional map M' is then stored in the memory 5 of the system 1 for future use in a method for detecting intrusions in a monitored volume as detailed above.

What is claimed is:

1. A method for detecting intrusions in a monitored volume, in which a plurality of N tridimensional sensors respectively monitor at least a part of a monitored volume and respectively communicate with a central processing unit, comprising:

each sensor of said plurality of N tridimensional sensors acquiring a local point cloud in a local coordinate system of said sensor, said local point cloud comprising a set of tridimensional data points of object surfaces in a local volume surrounding said sensor and overlapping the monitored volume, said central processing unit receiving the acquired local point clouds from the plurality of N tridimensional sensors, storing said acquired point clouds in a memory and, for each sensor of said plurality of N tridimensional sensors, computing updated tridimensional position and orientation of said sensor in a global coordinate system of the monitored volume by aligning a local point cloud acquired by said tridimensional sensor with a global tridimensional map of the monitored volume stored in a memory, and generating an aligned local point cloud from said acquired point cloud on the basis of the updated tridimensional position and orientation of the sensor, and monitoring an intrusion in the monitored volume by comparing a free space of said aligned local point cloud with a free space of the global tridimensional map.

2. The method according to claim 1 wherein, for each sensor of said plurality of N tridimensional sensors, the updated tridimensional position and orientation of said sensor in the global coordinate system is computed by performing a simultaneous multi-scan alignment of each point cloud acquired by said sensor with the global tridimensional map of the monitored volume.

3. The method according to claim 1, wherein the updated tridimensional position and orientation of each sensor of said plurality of N tridimensional sensors is computed only from the local point clouds acquired by said tridimensional sensor and the global tridimensional map of the monitored volume stored in a memory, and without additional positioning information.

4. The method according to claim 1, wherein the N tridimensional sensors are located so that a union of the local volumes surrounding said sensors is a connected space, said connected space forming the monitored volume, and wherein the global tridimensional map of the monitored volume is determined by:

receiving at least one local point cloud from each of said plurality of N tridimensional sensors and storing said local point clouds in a memory, performing a simultaneous multi-scans alignment of the stored local point clouds to generate a plurality of aligned local point clouds respectively associated to the local point clouds acquired from each of said plurality of N tridimensional sensors, and merging said plurality of aligned local point clouds to determine a global tridimensional map of the monitored volume and storing said global tridimensional map in the memory.

5. The method according to claim 1, further comprising displaying to a user a graphical indication of the intrusion on a display device.

6. The method according to claim 5, further comprising generating a bidimensional image of the monitored volume by projecting the global tridimensional map of the monitored volume, and commanding the display device to display the graphical indication of the intrusion overlaid over said bidimensional image of the monitored volume.

7. The method according to claim 5, wherein the method is for a self-calibrated monitoring system, the method further comprising commanding the display device to display the graphical indication of the intrusion overlaid over a bidimensional image of at least a part of the monitored volume acquired by a camera of the self-calibrated monitoring system.

8. The method according to claim 7, further comprising orienting the camera of the self-calibrated monitoring system so that the detected intrusion is located in a field of view of the camera.

9. A method for extending a volume monitored by a method according to claim 1, in which a plurality of N tridimensional sensors respectively monitor at least a part of the monitored volume and respectively communicate with a central processing unit, comprising:

positioning an additional N+lth tridimensional sensor communicating with the central processing unit, the additional N+lth tridimensional sensor acquiring a local point cloud in a local coordinate system of said sensor, said local point cloud comprising a set of tridimensional data points of object surfaces in a local volume surrounding said sensor and at least partially overlapping the volume monitored by the plurality of N tridimensional sensors, determining an updated global tridimensional map of a self-calibrated monitoring system by:

receiving at least one local point cloud acquired from each of said plurality of N tridimensional sensors and storing said local point clouds in a memory, performing a simultaneous multi-scans alignment of the stored local point clouds to generate a plurality of aligned local point clouds respectively associated to the local point clouds acquired from each of said plurality of N tridimensional sensors, and determining a global tridimensional map of a monitored volume by merging said plurality of aligned local point clouds.

10. A method for determining a tridimensional location of a camera for a self-calibrated monitoring system, in which a plurality of N tridimensional sensors respectively monitor at least a part of a monitored volume and respectively communicate with a central processing unit, providing the camera, wherein the camera comprises at least one reflective pattern such that a data point of said reflective pattern acquired by a tridimensional sensor of the self-calibrated monitoring system can be associated to said camera in the monitored volume, in a field of view of at least one sensor of the plurality of N tridimensional sensors so that said sensor acquire a local point cloud comprising at least one tridimensional data point of the reflective pattern of the camera, receiving a local point cloud from said at least one tridimensional sensor and computing an aligned local point cloud by aligning said local point cloud with a global tridimensional map of the self-calibrated monitoring system, identifying, in the aligned local point cloud at least one data point corresponding to the reflective pattern of the camera, and determining at least a tridimensional location of the camera in a global coordinate system of the global tridimensional map on the basis of the coordinates of said identified data point of the aligned local point cloud corresponding to the reflective pattern of the camera.

11. A self-calibrated monitoring system for detecting intrusions in a monitored volume, the system comprising:

a plurality of N tridimensional sensors respectively able to monitor at least a part of the monitored volume, each sensor of said plurality of N tridimensional sensors being able to acquire a local point cloud in a local coordinate system of said sensor, said local point cloud comprising a set of tridimensional data points of object surfaces in a local volume surrounding said sensor and overlapping the monitored volume;

a memory to store said local point cloud and a global tridimensional map of a monitored volume comprising a set of tridimensional data points of object surfaces in a monitored volume, the local volume at least partially overlapping the monitored volume, a central processing unit able to receive the acquired local point clouds from the plurality of N tridimensional sensors, store said acquired point clouds in a memory and, for each sensor of said plurality of N tridimensional sensors, compute updated tridimensional position and orientation of said sensor in a global coordinate system of the monitored volume by aligning a local point cloud acquired by said tridimensional sensor with a global tridimensional map of the monitored volume stored in a memory, generate an aligned local point cloud from said acquired point cloud on the basis of the updated tridimensional position and orientation of the sensor, and monitor an intrusion in the monitored volume by comparing a free space of said aligned local point cloud with a free space of the global tridimensional map.

12. The monitoring system according to claim 11, further comprising at least one camera able to acquire a bidimensional image of a portion of the monitored volume.

13. The monitoring system according to claim 12, wherein said at least one camera comprises at least one reflective pattern such that a data point of said reflective pattern acquired by a tridimensional sensor of the self-calibrated monitoring system can be associated to said camera by the central processing unit of the system.

14. The monitoring system according to claim 11, further comprising at least one display device able to display to a user a graphical indication of the intrusion.

15. A non-transitory computer readable storage medium, having stored thereon a computer program comprising program instructions, the computer program being loadable into a central processing unit of a monitoring system and adapted to cause the processing unit to carry out the steps of a method when the computer program is run by the central processing unit, the method comprising:

each sensor of a plurality of N tridimensional sensors acquiring a local point cloud in a local coordinate system of said sensor, said local point cloud comprising a set of tridimensional data points of object surfaces in a local volume surrounding said sensor and overlapping a monitored volume, said central processing unit receiving the acquired local point clouds from the plurality of N tridimensional sensors, storing said acquired point clouds in a memory and, for each sensor of said plurality of N tridimensional sensors, computing updated tridimensional position and orientation of said sensor in a global coordinate system of the monitored volume by aligning a local point cloud acquired by said tridimensional sensor with a global tridimensional map of the monitored volume stored in a memory, and generating an aligned local point cloud from said acquired point cloud on the basis of the updated tridimensional position and orientation of the sensor, and monitoring an intrusion in the monitored volume by comparing a free space of said aligned local point cloud with a free space of the global tridimensional map.

* * * * *